US012240676B2

(12) United States Patent
Wakimoto et al.

(10) Patent No.: US 12,240,676 B2
(45) Date of Patent: Mar. 4, 2025

(54) PACKING MATERIAL

(71) Applicant: KYOCERA Document Solutions Inc., Osaka (JP)

(72) Inventors: Atsuhiro Wakimoto, Osaka (JP); Shinji Nemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 10 days.

(21) Appl. No.: 18/352,039

(22) Filed: Jul. 13, 2023

(65) Prior Publication Data

US 2024/0025616 A1 Jan. 25, 2024

(30) Foreign Application Priority Data

Jul. 22, 2022 (JP) ..... 2022-117252

(51) Int. Cl.
*B65D 81/127* (2006.01)

(52) U.S. Cl.
CPC ..... *B65D 81/127* (2013.01)

(58) Field of Classification Search
CPC .. B65D 81/127; B65D 81/053; B65D 81/025; B65D 81/113; B65D 5/5035; B65D 5/5028; B65D 2581/053
USPC ..... 206/521, 523, 320, 453, 576, 586, 206/592–594; 217/73
See application file for complete search history.

(56) References Cited

U.S. PATENT DOCUMENTS 2,954,140 A * 9/1960 Sutherland ..... B65D 85/68 217/53
3,192,680 A * 7/1965 Mantell ..... B65D 5/509 206/811
3,356,209 A * 12/1967 Pezely, Jr. ..... B65D 81/107 206/523
4,162,729 A * 7/1979 Kaiser ..... B65D 5/5028 206/592
5,398,808 A * 3/1995 Chen ..... B65D 5/5071 206/320
5,692,618 A * 12/1997 Beak ..... B65D 5/5088 206/592
6,155,419 A * 12/2000 Sowa ..... B65D 75/004 206/320

(Continued)

FOREIGN PATENT DOCUMENTS

JP H 09-249262 A 9/1997
JP 2001039436 A * 2/2001

(Continued)

*Primary Examiner* — Chun Hoi Cheung
*Assistant Examiner* — Brijesh V. Patel
(74) *Attorney, Agent, or Firm* — Stein IP, LLC

(57) ABSTRACT

A packing material includes: a packing case; a support member arranged inside the packing case and having a first side plate facing one side face of a packed article in a first direction; a cushioning member disposed between the packing case and the first side plate and absorbing shock applied from the first direction to the packed article; and a shock distribution plate disposed between the first side plate and the cushioning member, larger than the contact area with the cushioning member and elongate in a second direction intersecting with the first direction. The shock distribution plate has such rigidity as not to deform against shock from the cushioning member.

3 Claims, 8 Drawing Sheets

(56) References Cited

U.S. PATENT DOCUMENTS 6,268,039 B1 * 7/2001 Chou ..... B65D 5/5069 206/583
6,274,217 B1 * 8/2001 Kim ..... B65D 5/509 428/218
6,340,087 B1 * 1/2002 Bridges ..... B65D 81/05 206/592
6,382,422 B1 * 5/2002 Bocek ..... B65D 81/113 206/592
6,390,296 B1 * 5/2002 Griffith ..... B65D 81/057 206/592
6,405,873 B2 * 6/2002 Koike ..... B65D 81/025 206/592
6,569,073 B1 * 5/2003 Bridges ..... B65B 5/108 493/260
6,644,476 B2 * 11/2003 Wu ..... B65D 81/05 206/586
6,666,334 B2 * 12/2003 Fujii ..... B65D 5/5033 206/592
6,837,421 B1 * 1/2005 Li ..... B65D 5/48024 229/120.32
6,986,456 B2 * 1/2006 Jone ..... B65D 5/643 229/117.11
7,093,717 B2 * 8/2006 Sakai ..... B65D 51/244 206/591
7,328,800 B2 * 2/2008 Koike ..... B65D 5/58 206/592
7,424,954 B2 * 9/2008 Otsuka ..... B65D 81/113 206/320
7,946,426 B2 * 5/2011 Ohsawa ..... B65D 81/056 206/586
8,215,484 B2 * 7/2012 Lim ..... B65D 81/058 206/592
8,240,469 B2 * 8/2012 Goda ..... B65D 19/20 206/386
8,720,691 B2 * 5/2014 Hu ..... B65D 5/5088 206/454
8,720,731 B2 * 5/2014 Tsuyuki ..... B65D 81/056 229/117.35
8,757,384 B2 * 6/2014 Ooi ..... B65D 5/5088 206/521
9,850,055 B2 * 12/2017 Nagashima ..... B65D 81/113
10,403,527 B2 * 9/2019 Nagashima ..... H01L 21/67386
11,161,669 B2 * 11/2021 Tsunashima ..... B65D 81/058
2002/0179469 A1 * 12/2002 Tornga ..... B65D 81/056 206/320
2003/0062286 A1 * 4/2003 Igarashi ..... B65D 81/052 383/3
2006/0219596 A1 * 10/2006 Lin ..... B65D 81/113 206/592
2012/0043249 A1 * 2/2012 Tsukii ..... B65D 81/05 206/521
2012/0097569 A1 * 4/2012 Murano ..... B65D 77/04 206/523
2014/0319011 A1 * 10/2014 Noguchi ..... B65D 5/5035 206/521
2015/0056011 A1 * 2/2015 Nakamura ..... B65D 19/20 403/408.1

FOREIGN PATENT DOCUMENTS

JP 2001072138 A * 3/2001
JP 2004010131 A * 1/2004
JP 2005001754 A * 1/2005 ..... B65D 81/052
JP 3811430 B2 * 8/2006
JP 4488390 B2 * 6/2010
JP 2010274936 A * 12/2010
WO WO-2014184845 A1 * 11/2014 ..... B65D 81/1075

* cited by examiner

PACKING MATERIAL

INCORPORATION BY REFERENCE

This application is based on and claims the benefit of priority from Japanese Patent Application No. 2022-117252 filed on Jul. 22, 2022, the contents of which are hereby incorporated by reference.

BACKGROUND

The present disclosure relates to a packing material.

Conventionally, a packing material including a cushioning member that absorbs shock to a packed article is known. The cushioning member is arranged to face the packed article. When shock is applied from the outside, it is absorbed by the deformation (crushing) of the cushioning member. However, even if the cushioning member is used, shock is applied to the packed article. If a part of the packed article facing the cushioning member has low strength, the packed article may be damaged even if the cushioning member absorbs shock.

SUMMARY

According to one aspect of the present disclosure, a packing material includes a packing case, a support member, a cushioning member, and a shock distribution plate. The support member is arranged inside the packing case and has a first side plate facing one side face of a packed article in a first direction. The cushioning member is disposed between the packing case and the first side plate and absorbs shock applied from the first direction to the packed article. The shock distribution plate is disposed between the first side plate and the cushioning member, is larger than a contact area with the cushioning member, and is elongate in a second direction intersecting with the first direction. The shock distribution plate has such rigidity as not to deform against shock from the cushioning member.

DETAILED DESCRIPTION

Figure 1:
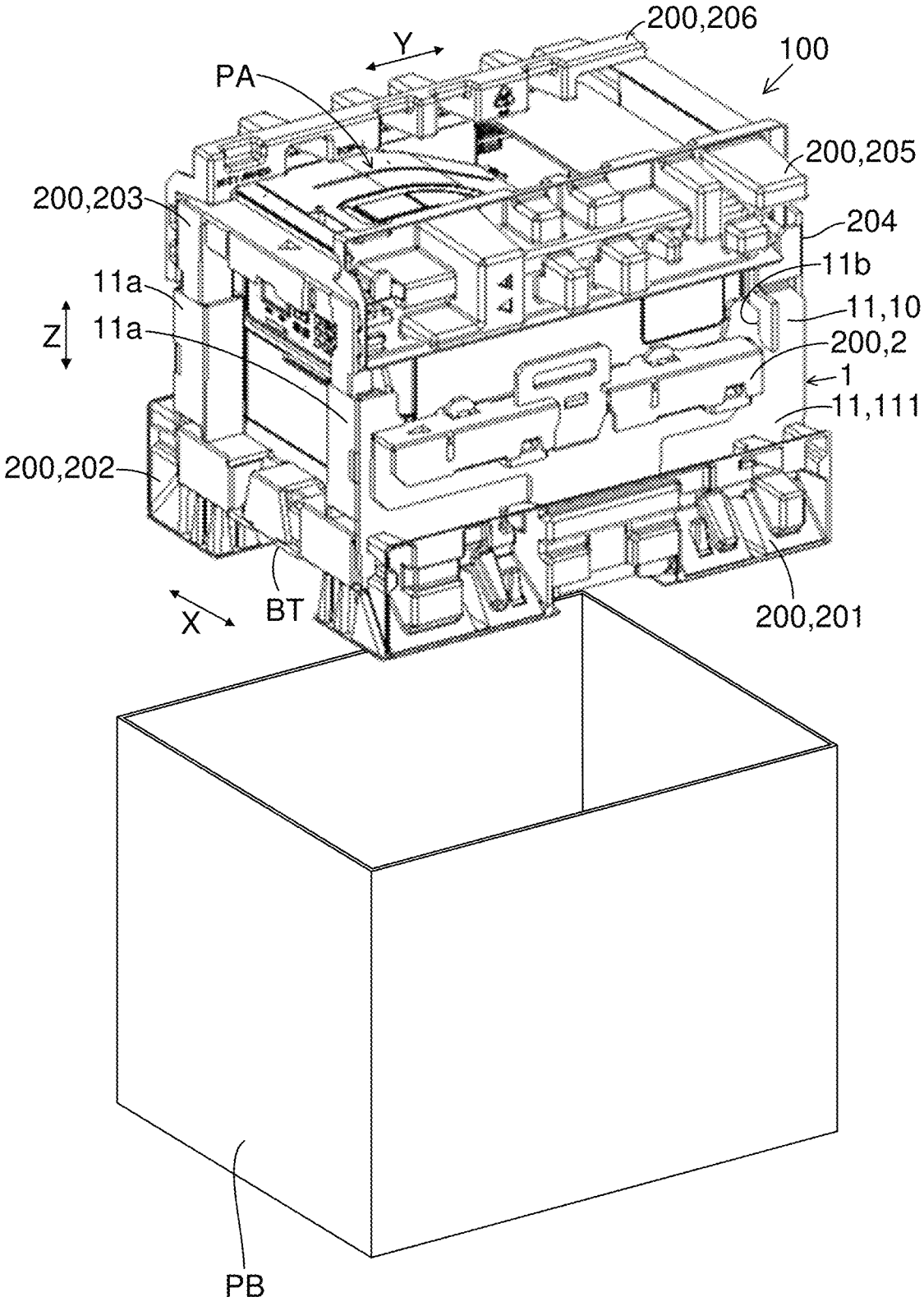
FIG. 1 is a perspective view, from the right side, of a packing material according to an embodiment of the present disclosure.
Figure 2:
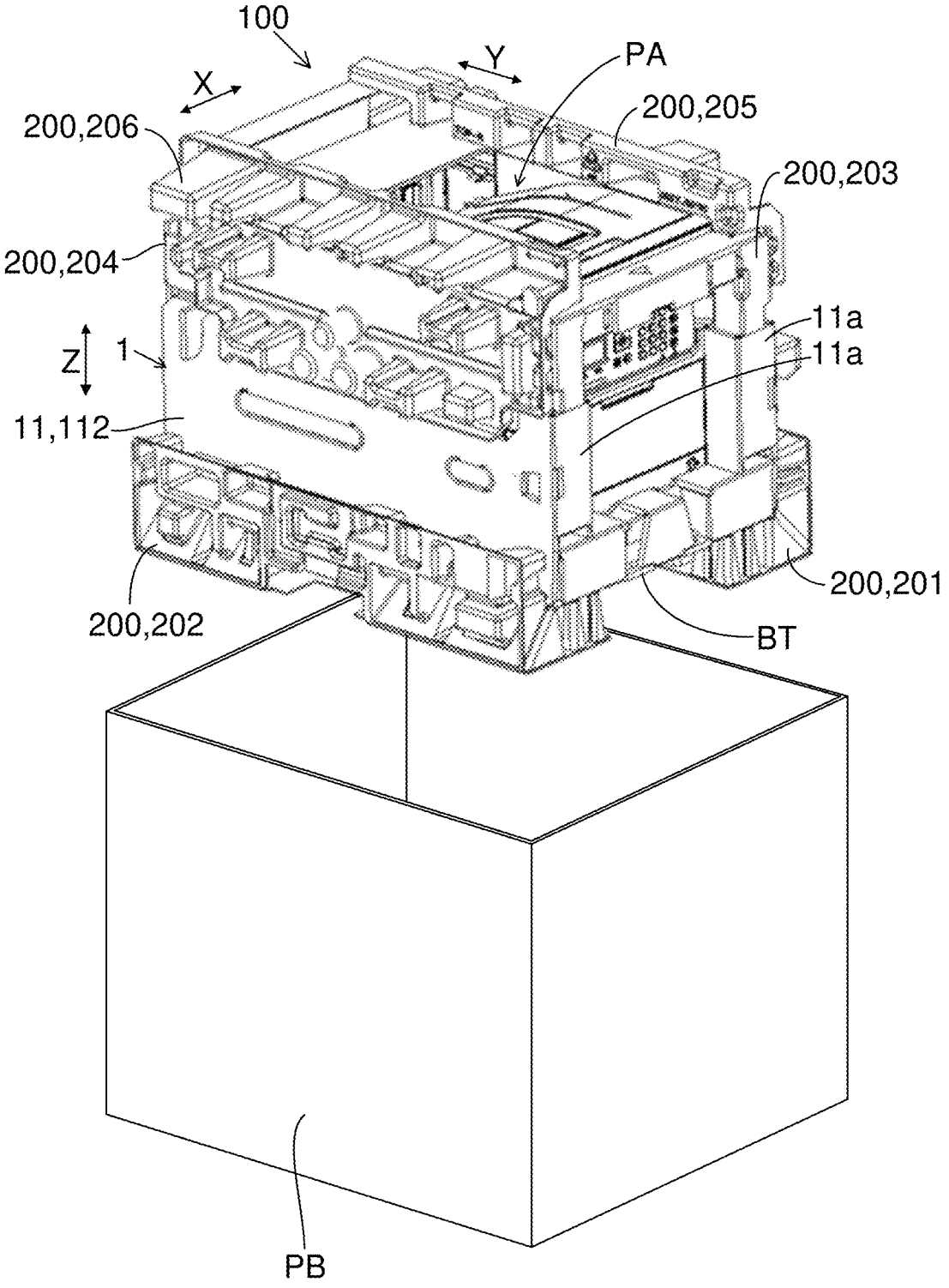
FIG. 2 is a perspective view, from the left side, of the packing material according to the embodiment of the present disclosure.

Hereinafter, a packing material 100 according to one embodiment of the present disclosure will be described with reference to FIGS. 1 to 7. In the following description, the X direction in the drawings is defined as the left-right direction. The Y direction orthogonal to the X direction is defined as the front-rear direction. The direction orthogonal to the X and Y directions is defined as the up-down direction. Note that the X direction corresponds to a "first direction" and the Y direction corresponds to a "second direction".

Overall Configuration

As shown in FIGS. 1 to 4, the packing material 100 according to the embodiment includes a support member 1, a cushioning member set 200, and a packing case PB. The support member 1 supports a packed article PA. The packed article PA, while being supported by the support member 1, can be put in the packing case PB or taken out from the packing case PB.

The support member 1 is formed of a single cardboard sheet. The support member 1 has a base plate BT and pair of side plates 11. The packed article PA is placed on the base plate BT.

The pair of side plates 11 is formed by bending upward the opposite ends of the base plate BT in the X direction. Of the pair of side plates 11 one is connected to the right end of the base plate BT and the other to the left end of the base plate BT. One side plate 11 corresponds to a "first side plate" and is in the following description identified by the reference sign "111" and called the first side plate 111. The other side plate 11 corresponds to a "second side plate" and is in the following description identified by the reference sign "112" and called the second side plate 112.

Each of the pair of side plates 11 is provided with a cylindrical portion 11*a* on the front side. With the support member 1 arranged inside the packing case PB, the cylinder axis direction of the cylindrical portion 11*a* is aligned with the Z direction. That is, each of the pair of the side plates 11 has an opening (hole) facing upward. Each cylindrical portion 11*a* of the pair of the side plates 11 is used to support a front cushioning member 203, which will be described later. Each of the pair of the side plates 11 is provided with a slit 11*b* cut from top down. Each slit 11*b* of the pair of the side plates 11 is used to support a rear cushioning member 204, which will be described later.

Each of the pair of side plates 11 is pivotable with its end on the side connected to the base plate BT as a fulcrum while swinging the tip on the side opposite from that end. With the packed article PA placed on the base plate BT, pivoting the pair of side plates 11 each inward (toward the packed article PA) results in the packed article PA being held between the pair of side plates 11 in the X direction. That is, the side plates 11 are disposed on the right and left sides, respectively, of the packed article PA. The first side plate 111 faces one side face (right side face) of the packed article PA in the X direction. The second side plate 112 faces the other side face (left side face) of the packed article PA in the X direction.

The packed article PA is accommodated in the packing case PB in a state where the packed article PA is held between the pair of side plates 11 in the X direction. In unpacking, the packed article PA is taken out from the packing case PB together with the support member 1. Thus, the pair of side plates 11 can be pivoted outward (away from the packed article PA), and then the packed article PA can be taken out from the support member 1.

The cushioning member set 200 is accommodated in the packing case PB together with the packed article PA. The cushioning member set 200 absorb shock to the packed article PA. The cushioning member set 200 surround the packed article PA supported by the support member 1 inside the packing case PB. The cushioning member set 200 is composed of a plurality of members. The packed article PA is surrounded by the plurality of members constituting the cushioning member set 200 inside the packing case PB.

The cushioning member set 200 has lower cushioning members 201 and 202, a front cushioning member 203, a rear cushioning member 204, and upper cushioning members 205 and 206.

Each of the lower cushioning members 201 and 202 is disposed in the lower right and left corners of the packed article PA. Each of the lower cushioning member 201 and 202 may be formed of a pulp molding material using a mold, by pulp molding.

The packed article PA is accommodated in the packing case PB in the following manner. First, each of the lower cushioning members 201 and 202 is accommodated in the pacing case PB. The lower cushioning member 201 is disposed in the lower right corner inside the packed case PB. The lower cushioning member 202 is disposed in the lower left corner inside the packed case PB. Then, the packed article PA supported by the support member 1 is accommodated in the packing case PB. In other words, each of the lower right and left corners of the packed article PA supported by the support member 1 is disposed on one of the lower cushioning members 201 and 202, respectively.

The front cushioning member 203 is disposed on the front side of the packed article PA. The front cushioning member 203 is formed of a single cardboard sheet. The rear cushioning member 204 is disposed on the rear side of the packed article PA. The rear cushioning member 204 is formed of a single cardboard sheet. Each of the front and rear cushioning members 203 and 204 is supported by the support member 1.

The front cushioning member 203 has a cylindrical portion (no reference sign given) of which the cylinder axis direction is aligned with the Z direction. The front cushioning member 203 is supported by the support member 1 with the cylindrical portion of the former inserted in the cylindrical portion 11*a* in the support member 1.

The rear cushioning member 204 has a slit (no reference sign given) cut from bottom up. The rear cushioning member 204 is supported by the support member 1 with the slit of the former inserted in the slit 11*b* in the support member 1.

After the packed article PA supported by the support member 1 is accommodated in the packing case PB, the cylindrical portion of the front cushioning member 203 is inserted into the cylindrical portion 11*a* in the support member 1. Also, after the packed article PA supported by the support member 1 is accommodated into the packing case PB, the slit in the rear cushioning member 204 is inserted into the slit 11*b* in the support member 1.

The upper cushioning members 205 and 206 are disposed in the upper right and left corners, respectively, of the packed article PA. The upper cushioning members 205 and 206 may be formed of a pulp molding material using a mold, by pulp molding.

Low-Strength Side Cushioning Member

Figure 5:
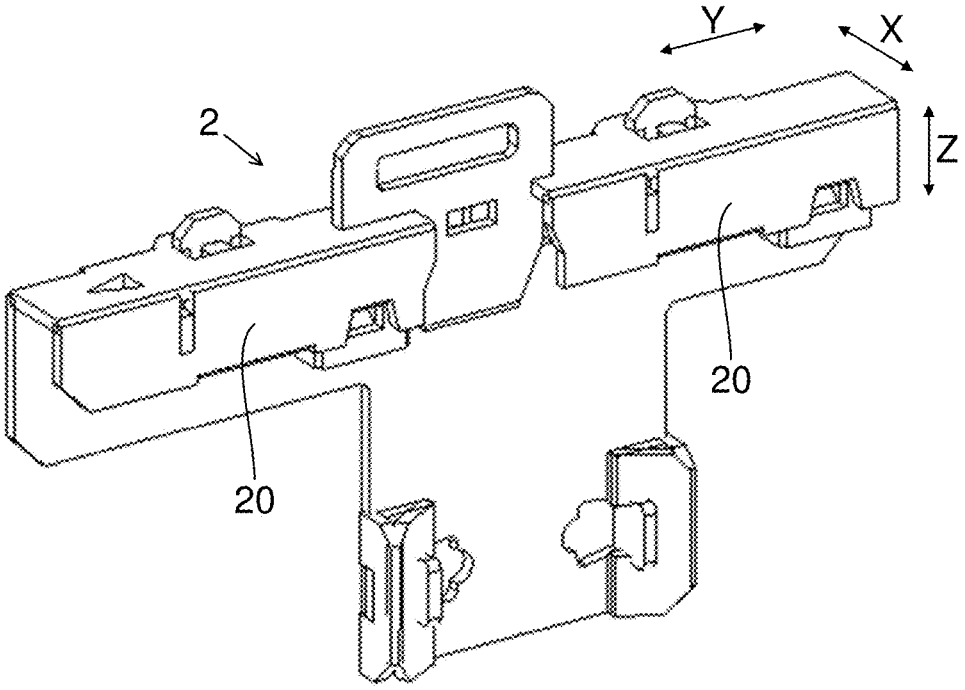
FIG. 5 is a perspective view of a cushioning member according to the embodiment of the present disclosure.

The cushioning member set 200 further includes a low-strength side member 2. The low-strength side member 2 alone is shown in FIG. 5. The low-strength side member 2 is formed of a single cardboard sheet S (see FIG. 6). The low-strength side member 2 has a cushioning member 20. The cushioning member 20 is formed by bending a part of the cardboard sheet S constituting the low-strength side member 2 into a square cylindrical shape.

Figure 6:
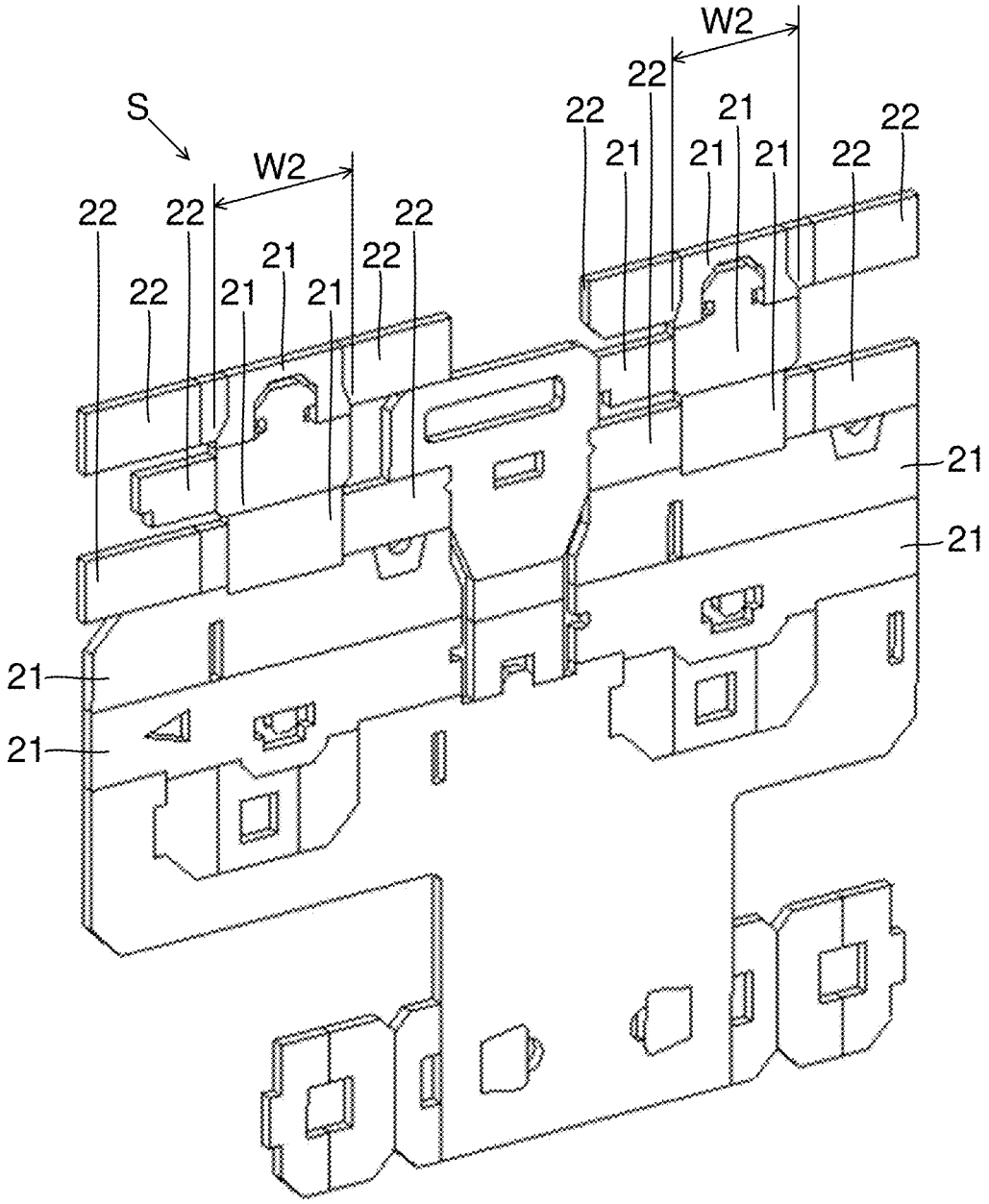
FIG. 6 is a perspective view of the cushioning member shown in FIG. 5 in an unfolded state.

For example, the low-strength side member 2 is formed of a cardboard sheet S as shown in FIG. 6. The cushioning member 20 is formed by processing the cardboard sheet S such that a part 21 is folded into a square cylindrical shape and that a part 22 is folded to be arranged inside the cylinder. When the low-strength side member 2 is formed of such a cardboard sheet S, the dimension indicated by "W2" in the figure is the width of the cushioning member 20 in the Y direction.

Note that there is no particular limitation on the material of the low-strength side member 2 (that is, the material of the cushioning member 20). The material of the low-strength side member 2 can be a foamed material or a pulp molding material. The low-strength side member 2 can be formed of a combination of a plurality of types of materials. For example, the low-strength side member 2 can be formed by bonding a cushioning member 20 formed of a foamed material and a pulp molding material to the cardboard sheet.

The cushioning member 20 is disposed on, of the outer surface of the packed article PA, a low-strength face LS (see FIG. 3) having lower strength than elsewhere and absorb shock to the low-strength face LS. For example, of the outer surface of the packed article PA, the right side face has lower strength than the other faces. Thus, the right side face of the packed article PA is a low-strength face LS. That is, the cushioning member 20 is disposed on the right side face of the packed article PA.

For example, if, like the right side face, the left side face of the packed article PA has low strength (if the left side face of the packed article PA is also a low-strength face LS), the cushioning member 20 can be disposed on the left side face of the packed article PA. That is, depending of the packed article PA, the cushioning member 20 can be disposed on both the right and left side faces of the packed article PA.

However, it is here assumed that only the right side face of the packed article PA is a low-strength face LS. Accordingly, the cushioning member 20 is disposed only on the right side face of the packed article PA. In other words, the low-strength side member 2 is disposed only on the right side face of the packed article PA.

The packed article PA is held between the pair of side plates 11 of the support member 1 (the first and second side plates 111 and 112) in the X direction. Thus, the first side plate 111 faces the low-strength face LS in the X direction. As a result, the first side plate 111 is, along with the cushioning member 20, disposed on the right side of the packed article PA.

The low-strength side member 2 is disposed outside of the first side plate 111 in the X direction. Thus, the cushioning member 20 is disposed between the packing case PB and the first side plate 111.

Note that the cushioning member 20 includes two of them: two cushioning members 20 are provided for one low-strength side member 2. The two cushioning members 20 are disposed apart from each other in the Y direction. The two cushioning members 20 are at the same position in the Z direction.

Shock Distribution at the Low-Strength Face

Figure 3:
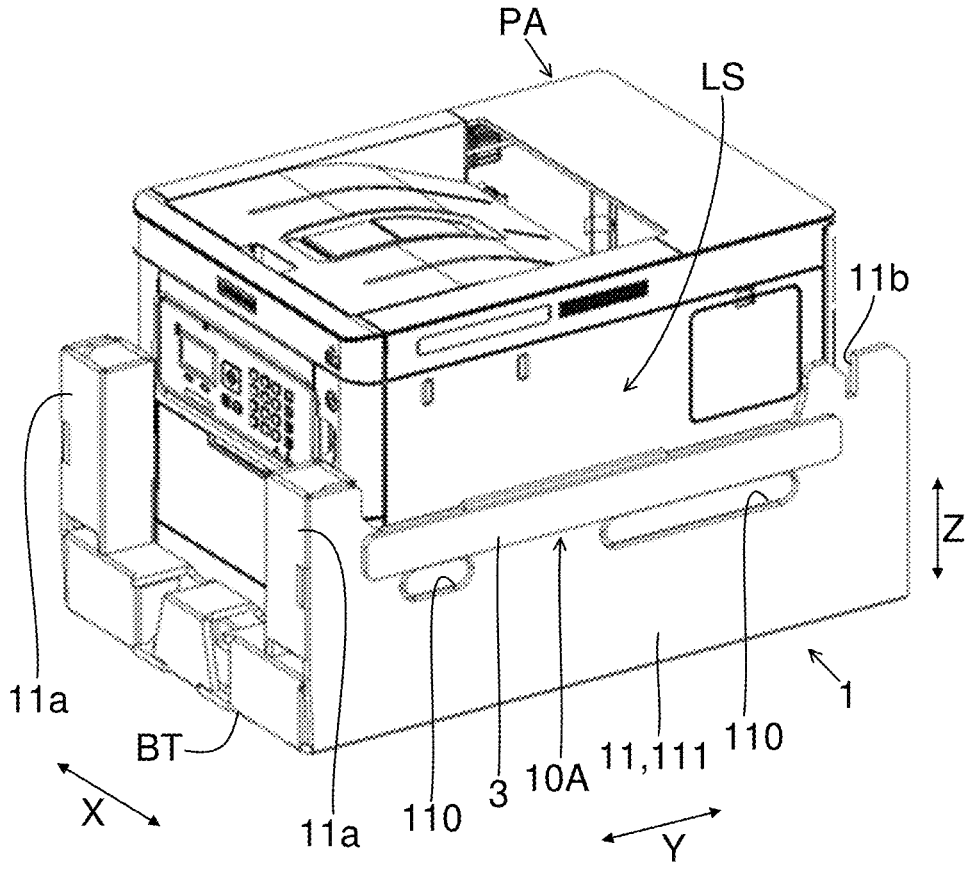
FIG. 3 is a perspective view of a support member according to the embodiment of the present disclosure.
Figure 4:
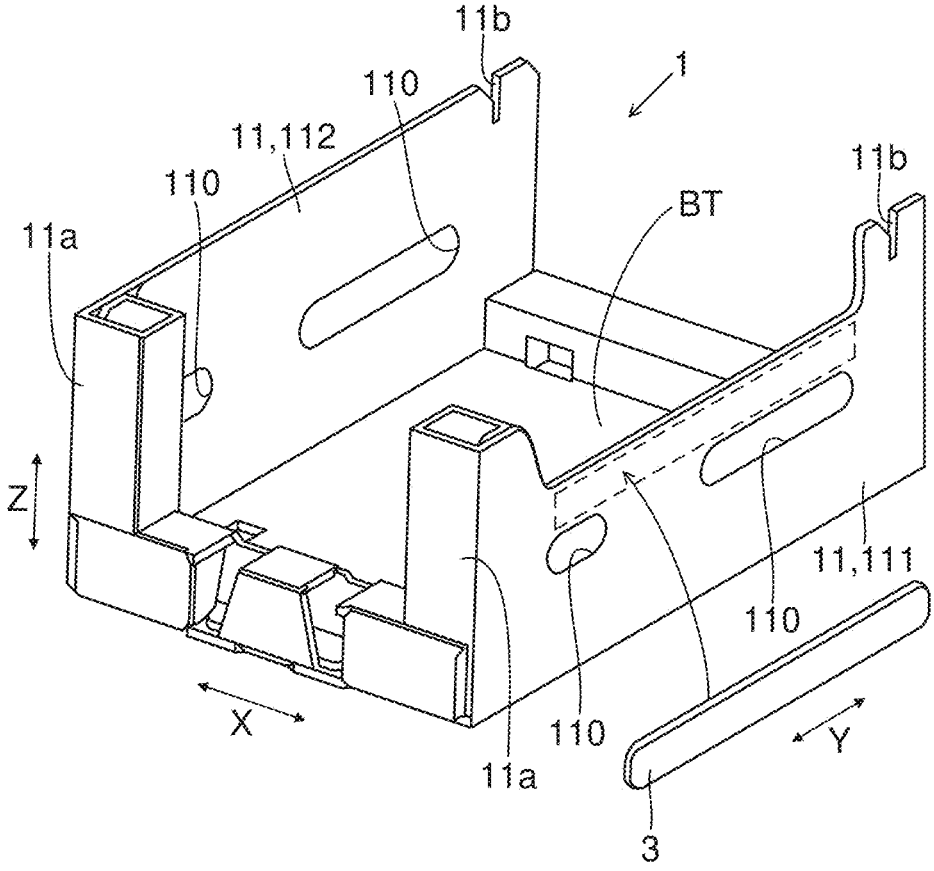
FIG. 4 is a perspective view showing the attachment position of a shock distribution plate to the support member according to the embodiment of the present disclosure.

The first side plate 111 has a shock distribution area 10A (see FIG. 3). The cushioning member 20 is disposed to face the shock distribution area 10A of the first side plate 111 in the X direction. In other words, the cushioning member 20 is disposed outside (on the right side of) the shock distribution area 10A of the first side plate 111 in the X direction. The shock distribution area 10A is an area thicker in the X direction than the other part of the first side plate 111. Since the shock distribution area 10A is thicker in the X direction than the other part of the first side plate 111, it is harder and more difficult to deform than the other part of the first side plate 111.

Figure 7:
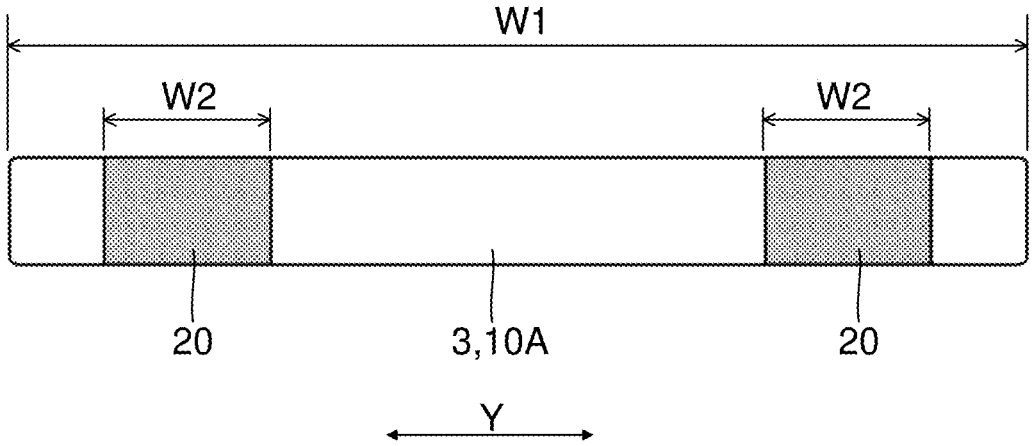
FIG. 7 is a schematic diagram showing the widths of the shock distribution plate and the cushioning member according to the embodiment of the present disclosure.

Here, the width W1 of the shock distribution area 10A in the Y direction is greater than the width W2 of the cushioning member 20 in the Y direction (see FIG. 7). In other words, the width W1 of a shock distribution plate 3, which will be described later, in the Y direction is greater than the width W2 of the cushioning member 20 in the Y direction. Specifically, as viewed from the X direction, the shock distribution area 10A extends continuously from a position overlapping one end of the packed article PA to a position overlapping the other end of it in the Y direction.

With this configuration, if the cushioning member 20 receives shock, it is possible to prevent the shock from concentrating at a position on the first side plate 111 that overlaps with the cushioning member 20 in the X direction. In other words, the shock received by the cushioning member 20 can be distributed over a wide area across the shock distribution area 10A. Thus, if the cushioning member 20 receives shock, the shock to the low-strength face LS of the packed article PA can be distributed over a wide area, and this helps prevent strong shock from concentrating only at a specific position on the low-strength face LS (a position that overlaps with the cushioning member 20 in the X direction).

For example, changing the material or increasing the volume of another cushioning member disposed on the right side of the packed article PA (that is, the lower and upper cushioning members 201 and 205) can also help suppress shock to the low-strength face LS of the packed article PA. However, that requires redesigning of the other cushioning member disposed on the right side of the packed article PA, which is troublesome.

By contrast, if the shock distribution area 10A is provided on the first side plate 111, it is only necessary to dispose a new cushioning material (that is, the cushioning member 20) at a position facing the shock distribution area 10A in the X direction. This makes it easy to suppress shock to the low-strength face LS of the packed article PA. It is then easy to suppress damage to the packed article PA having the low-strength face LS which is lower in strength than elsewhere.

Structure of the Shock Distribution Area

The packing material 100 includes a shock distribution plate 3. The shock distribution plate 3 is disposed between the first side plate 111 and the cushioning member 20. As viewed from the X direction, the area of the shock distribution plate 3 is larger than the contact area with the cushioning member 20. The shock distribution plate 3 is elongate in the Y direction. The shock distribution plate 3 is attached to the first side plate 111 (see FIG. 4). The shock distribution area 10A is the area on the first side plate 111 to which the shock distribution plate 3 is attached. There is no particular limitation on the method of attaching the shock distribution plate 3; it may be attached with adhesive or double-sided tape.

The shock distribution plate 3 is a separate member from the support member 1. The shock distribution plate 3 is formed of a material different from that of the cardboard sheet. By forming the shock distribution plate 3 from a material harder than the cardboard sheet, the shock distribution plate 3 has such rigidity as not to deform against shock from the cushioning member 20. For example, the shock distribution plate 3 is made of paper and formed of a paperboard with a thickness of about 5 mm. The shock distribution plate 3 may be formed of a wooden plate or a metal plate. The shock distribution plate 3 may be made of a pulp molding material with a thickness of about 5 mm.

The shock distribution plate 3 may be a cardboard sheet. That is, a cardboard sheet separate from the support member 1 may be attached to the shock distribution area 10A. This also makes the shock distribution area 10A of a low-strength side holding portion 10 thicker and harder than elsewhere.

Attaching the shock distribution plate 3 separate from the support member 1 to the first side plate 111 makes it easy to provide the shock distribution area 10A thicker and harder than elsewhere can be easily on the first side plate 111. In other words, it is then easy to use a part of the first side plate 111 facing the low-strength face LS of the packed article PA in the X direction as the shock distribution area 10A. Using a paperboard, a wooden plate, a metal plate, a pulp molding material, or the like as the shock distribution plate 3 makes it easier to distribute shock across the shock distribution area 10A.

On the right side of the packed article PA, if the center of mass of the packed article PA lies at its middle in the horizontal direction (Y direction), with respect to its middle, a plurality of cushioning members 20 are disposed evenly distributed in the horizontal direction. The shock distribution plate 3 is elongate in the horizontal direction and makes contact with all of the plurality of cushioning members 20. Thus, with the plurality of cushioning members 20, shock can be distributed over a wide area.

Figure 8:
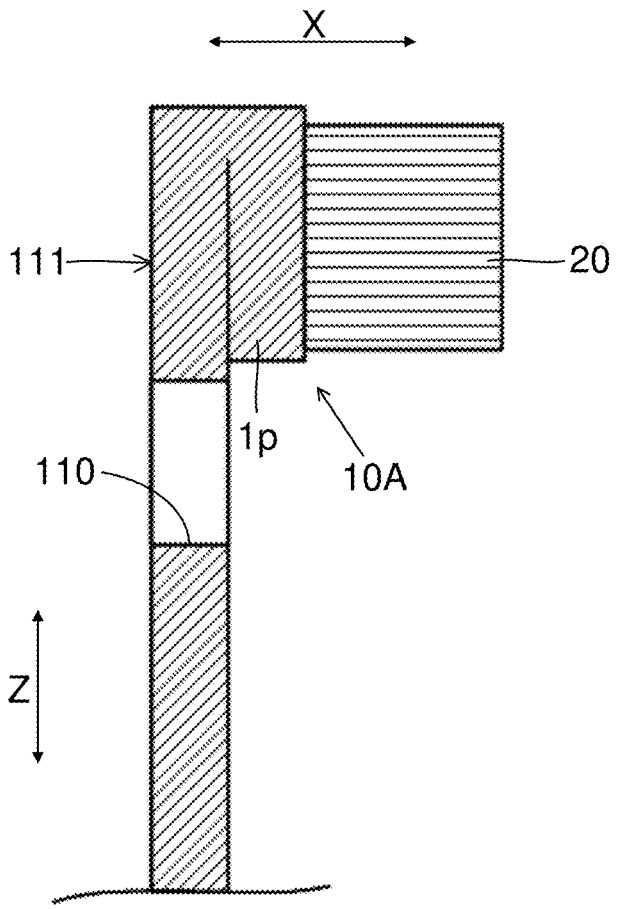
FIG. 8 is a schematic diagram showing the structure of a shock distribution plate according to a modified example.

Here, as a modified example, the shock distribution area 10A may be formed of the same member as the support member 1. In the modified example, as shown in FIG. 8, the shock distribution area 10A is formed by bending a part 1*p* of the cardboard sheet constituting the support member 1 so that the cardboard sheet is folded in the X direction. In the modified example, since it is not necessary to prepare a member separate from the support member 1, the number of components can be reduced.

Position of the Shock Distribution Area

The pair of side plates 11 (the first and second side plates 111 and 112) each have an opening penetrating it in the X direction as a grip 110. Each grip 110 in the pair of side plates 11 is an elongate hole with the Y direction as its longitudinal direction. Actually, the pair of side plates 11 each have two grips 110. The two grips 110 in each of the pair of side plates 11 are at the same position in the Z direction and are disposed apart in the Y direction.

In the packing and unpacking of the packed article PA, the support member 1 is lifted up with fingers inserted in the grips 110. At this time, the packed article PA is lifted up together with the support member 1. This makes it easy to accommodate the packed article into the packing case PB. It is also easy to take out the packed article PA from the packing case PB.

When the support member 1 is lifted up with fingers inserted in the grips 110, a force is applied upward to the top inner edges of the openings as the grips 110. Thus, it is preferable to reinforce the circumference of the grip 110.

To achieve that, the shock distribution area 10A is disposed immediately above the grips 110 in the first side plate 111. That is, the shock distribution plate 3 is attached immediately above the grips 110 in the first side plate 111. Thus, the top edges of the openings as the grips 110 are reinforced by the shock distribution plate 3. This helps prevent deformation around the grips 110 in the first side plate 111 (breakage of the first side plate 111).

It should be understood that the above-described embodiments are in every aspect illustrative and not restrictive. The technical scope of the present disclosure is defined not by the description of the embodiments given above but by the appended claims, and encompasses any modifications made without departure from the scope and sense equivalent to those claims.

What is claimed is:

1. A packing material comprising:

a packing case;

a support member arranged inside the packing case, the support member having a first side plate facing one side face of plural sides of a packed article in a first direction;

a cushioning member disposed between the packing case and the first side plate, the cushioning member absorbing shock applied from the first direction to the packed article; and a shock distribution plate disposed between the first side plate and the cushioning member, the shock distribution plate being larger than a contact area with the cushioning member and elongate in a second direction intersecting with the first direction, wherein the support member includes a second side plate facing the first side plate in the first direction, and a base plate connecting the first side plate and the second side plate together and for placing the packed article thereon, the first side plate has, as a grip, an opening penetrating the first side plate in the first direction, the second side plate has, as a grip, an opening penetrating the second side plate in the first direction, lifting the support member upward with fingers inserted in the grips causes the packed article to be lifted up together with the support member, the shock distribution plate is attached immediately above the grip in the first side plate, and the one side face having a lower strength than other ones of the side faces.

2. The packing material according to claim 1, wherein the support member is formed of a cardboard sheet, and the shock distribution plate is formed of a material harder than the cardboard sheet.

3. The packing material according to claim 1, wherein the shock distribution plate is formed by overlaying cardboard sheets together.

* * * * *